US006635120B2

(12) United States Patent
Tokoro et al.

(10) Patent No.: US 6,635,120 B2
(45) **Date of Patent: *Oct. 21, 2003**

(54) METHOD FOR PRODUCING SINTERED RARE EARTH MAGNET AND SINTERED RING MAGNET

(75) Inventors: Hisato Tokoro, Saitama-ken (JP); Kimio Uchida, Saitama-ken (JP)

(73) Assignee: Hitachi Metals, Ltd., Tokyo (JP)

( * ) Notice: Subject to any disclaimer, the term of this patent is extended or adjusted under 35 U.S.C. 154(b) by 22 days.

This patent is subject to a terminal disclaimer.

(21) Appl. No.: 09/951,480

(22) Filed: Sep. 14, 2001

(65) Prior Publication Data

US 2002/0054824 A1 May 9, 2002

(30) Foreign Application Priority Data

Sep. 14, 2000 (JP) ..... 2000-280104

(51) Int. Cl.[7] ..... H01F 1/053; H01F 1/08; B22F 3/12

(52) U.S. Cl. ..... 148/105; 148/101; 419/23; 419/33; 419/36

(58) Field of Search ..... 419/36, 23, 33; 148/101, 105

(56) References Cited

U.S. PATENT DOCUMENTS 6,312,494 B1 * 11/2001 Tokoro et al. ..... 75/245
6,447,621 B1 * 9/2002 Tokoro et al. ..... 148/302

FOREIGN PATENT DOCUMENTS

JP 06-322469 11/1994

* cited by examiner

*Primary Examiner*—Daniel J. Jenkins
(74) *Attorney, Agent, or Firm*—Sughrue Mion, PLLC

(57) ABSTRACT

A sintered rare earth magnet is produced by finely pulverizing a coarse rare earth magnet alloy powder to an average particle size of 1–10 μm in a non-oxidizing atmosphere; introducing the resultant fine rare earth magnet alloy powder into a non-oxidizing liquid comprising at least one oil selected from the group consisting of mineral oils, synthetic oils and vegetable oils, and at least one lubricant selected from the group consisting of esters of aliphatic acids and monovalent alcohols, esters of polybasic acids and monovalent alcohols, esters of aliphatic acids and polyvalent alcohols and their derivatives to prepare a slurry; molding the slurry; degreasing the resultant green body; sintering the degreased green body; and then heat-treating the green body.

7 Claims, 4 Drawing Sheets

METHOD FOR PRODUCING SINTERED RARE EARTH MAGNET AND SINTERED RING MAGNET

FIELD OF THE INVENTION

The present invention relates to a method for producing a sintered rare earth magnet having a low oxygen content and high density and orientation, and to a high-performance, ring-shaped, R-T-B-based, sintered magnet having a lower oxygen content, a higher density and higher orientation in a polar anisotropic or radially dipolar direction than those of the conventional sintered magnets.

BACKGROUND OF THE INVENTION

R—Fe—B based, sintered magnets, wherein R is at least one of rare earth elements including Y, are produced by coarsely pulverizing R—Fe—B-based alloys of desired compositions, finely pulverizing them in an inert gas such as nitrogen, etc., molding the resultant fine R—Fe—B-based alloy powder having an average particle size of 1–10 $\mu$m in a magnetic field, sintering the resultant green body, and then heat-treating the resultant sintered magnet. To provide the R—Fe—B-based, sintered magnets with improved residual magnetic flux density Br and maximum energy product $(BH)_{max}$, it is extremely important that the R—Fe—B-based, sintered magnets have reduced oxygen content. In view of this fact, the applicants previously discovered mineral oils and synthetic oils having a function to prevent the oxidation of the fine R—Fe—B-based alloy powder, and proposed a process for producing high-performance, R—Fe—B-based, sintered magnet having a low oxygen content and a high density, which comprises a introducing the fine R—Fe—B-based alloy powder into the above mineral or synthetic oil to form a slury, molding the slurry, degreasing the resultant green body, and then sintering and heat-treating it (see Japanese Patent 2,731,337, etc.).

This production process is advantageous in that the fine power and the green body are covered with the above oil to protect them from the air, thereby substantially suppressing their oxidation. Thus, the R—Fe—B-based, sintered body obtained by degreasing and sintering has as low an oxygen content as corresponding to that of the coarse R—Fe—B-based alloy powder before fine pulverization. Because this production process suffers from little decrease in the percentages of the R elements in the R—Fe—B-based alloy due to oxidation during sintering, a rare earth-rich phase forming a grain boundary phase is well kept in the resultant R—Fe—B-based, sintered body. Therefore, the R content in the green body can be set small, leading to decrease in excess R-rich phase and rare earth oxides and thus increase in a volume ratio of $R_2Fe_{14}B$-type crystal grains (main phase), which constitute a ferromagnetic phase, than he conventional sintered magnets. Therefore, this production process can provide a sintered magnet with remarkably improved Br and $(BH)_{max}$.

However, there is recently strong demand to miniaturize and reduce in weight magnet-comprising electric appliances such as VCMs, CD pickups, motors for domestic electric appliances, etc., resulting in increasingly higher demand to miniaturize and reduce in weight sintered rare earth magnets used in these electric appliances. Though the process of Japanese patent 2,731,337 was considered satisfactory to this demand, higher Br and $(BH)_{max}$ than those achieved by Japanese patent 2,731,337 are now demanded. The inventors' research has revealed that there is room for improving the magnetic orientation of the slurry.

OBJECT OF THE INVENTION

Accordingly, an object of the present invention is to provide a method for producing a sintered rare earth magnet having a low oxygen content and high density and orientation.

Another object of the present invention is to provide a polar anisotropic or radially bipolar, R-T-B-based, sintered ring magnet having low oxygen content and high density and orientation.

SUMMARY OF THE INVENTION

The method for producing a sintered rare earth magnet comprising the steps of finely pulverizing a coarse rare earth magnet alloy powder to an average particle size of 1–10 $\mu$m in a non-oxidizing atmosphere; introducing the resultant fine rare earth magnet alloy powder into a non-oxidizing liquid comprising at least one oil selected from the group consisting of mineral oils, synthetic oils and vegetable oils, and at least one lubricant selected from the group consisting of esters of aliphatic acids and monovalent alcohols, esters of polybasic acids and monovalent alcohols, esters of aliphatic acids and polyvalent alcohols and their derivatives to prepare a slurry; molding the slurry; degreasing the resultant green body; sintering the degreased green body; and then heat-treating the green body.

A weight ratio of the lubricant to the fine rare earth magnet alloy powder is preferably 0.01/99.99 to 0.5199.5.

The sintered rare earth magnet may further comprise 0.01–0.2 weight % of Ga, 0.01–0.3 weight % of Al, and 0.01–0.8 weight % of Nb.

The polar anisotropic ring magnet having is constituted by an R—Fe—Co—Cu—B-based, sintered magnet comprising 28–33 weight % of R, wherein R is at least one rare earth element including Y, 50 atomic % or more of R being occupied by Nd, 0.8–1.5 weight % of B, 0.5–5 weight % of Co, and 0.01–0.3 weight % of Cu, the balance being substantially Fe and inevitable impurities; the amount of oxygen inevitably contained being 0.3 weight % or less based on the total weight of the ring magnet; the ring magnet having a density of 7.56 g/cm$^3$ or more; and a ratio of I (105)/I (006) being 0.5–0.8, wherein I (105) and I (006) are X-ray diffraction peak intensity measured with respect to (105) and (006) planes, respectively, at a middle position on an outer surface between magnetic poles of the ring magnet. With I(105)/I (006)=0.5–0.8, the sintered magnet has higher Br and (B) than those of the conventional sintered magnets.

The radially dipolar ring magnet of the present invention is constituted by an R—Fe—Co—Cu—B-based, sintered magnet comprising 28–33% by weight of R, wherein R is at least one rare earth element including Y, 50 atomic % or more of R being occupied by Nd, 0.8–1.5% by weight of B, 0.5–5 weight % of Co, and 0.01–0.3 weight % of Cu, the balance being substantially Fe and inevitable impurities; the amount of oxygen inevitably contained being 0.3 weight % or less based on the total weight of the ring magnet; the ring magnet having a density of 7.56 g/cm$^3$ or more and an intrinsic coercivity iHc of 1.1 MA/m (14 kOe) or more at room temperature; and the degree of orientation expressed by [(Br//) 1 (Br//+Bri⊥)]×100(%) being 85.5% or more, wherein Br// is a residual magnetic flux density in an orientation direction at room temperature, and Br⊥ is a residual magnetic flux density in a longitudinal direction perpendicular to the orientation direction.

The thin, sintered arc segment magnet having a thickness of 1–4 mm according to the present invention is constituted by an R'—Fe—B-based, sintered magnet comprising 28–33 weight % of R', wherein R' is at least one of rare earth elements including Y, 50 atomic % or more of R' being occupied by Pr, 0.8–1.5 weight % of B, 5 weight % or less of Co, and 0.3 weight % or less of Cu, the balance being substantially Fe and inevitable impurities; the amount of oxygen inevitably contained being 0.3 weight % or less based on the total weight of the arc segment magnet; the arc segment magnet having a density of 7.50 g/cm$^3$ or more, a coercivity iHc of 1.1 MA/m (14 kOe) or more at room temperature, and orientation ($Br/4\pi I_{max}$) of 96% or more in an anisotropy direction.

The thin, sintered arc segment magnet preferably has parallel anisotropy and a length of 40–100 mm. Further, a ratio of I (105)/I (006) is preferably 0.5–0.8, wherein I (105) and I (006) are X-ray diffraction peak intensity measured with respect to (105) and (006) planes, respectively, using CuKα1-ray (λ=0.15405 nm). With I (105)/I (006)=0.5–0.8, the thin, sintered arc segment magnet has higher Br and (BH than those of the conventional sintered magnets.

The radially anisotropic, sintered arc segment magnet having an inner diameter of 100 mm or less according to the present invention is constituted by an R'—Fe—B-based, sintered magnet comprising 28–33 weight % of R', wherein R' is at least one of rare earth elements including Y, 50 atomic % or more of R' being occupied by Pr, 0.8–1.5 weight % of B, 5 weight % or less of Co, 0.3 weight % or less of Cu, the balance being substantially Fe and inevitable impurities; the amount of oxygen inevitably contained being 0.3 weight % or less based on the total weight of the arc segment magnet; the arc segment magnet having a density of 7.50 g/cm3 or more and a coercivity iHc of 1.1 MA/m (14 kOe) or more at room temperature; and the degree of orientation expressed by $[(Br//)/(Br//+Br\perp)]\times100(\%)$ being 85.5% or more, wherein Br// is a residual magnetic flux density in a radial direction at room temperature, and Br⊥ is a residual magnetic flux density in a longitudinal direction perpendicular to the radial direction.

This arc segment magnet is preferably as thin as 14 mm and as long as 40–100 mm in an axial direction.

The radially anisotropic, sintered ring magnet having an inner diameter of 100 mm or less according to the present invention is constituted by an R'—Fe—B-based, sintered magnet comprising 28–33 weight % of R', wherein R' is at least one of rare earth elements including Y, 50 atomic % or more of R' being occupied by Pr, 0.8–1.5 weight % of B, 5 weight % or less Co, 0.3 weight % or less of Cu, the balance being substantially Fe and inevitable impurities; the amount of oxygen inevitably contained being 0.3 weight % or less based on the total weight of the ring magnet; the ring magnet having a density of 7.50 g/cm$^3$ or more and a coercivity iHc of 1.1 MA/m (14 kOe) or more at room temperature; and the degree of orientation expressed by $[(Br//)/(Br//+Br\perp)]\times100$ (%) being 85.5% or more, wherein Br// is a residual magnetic flux density in a radial direction at room temperature, and Br⊥ is a residual magnetic flux density in a longitudinal direction perpendicular to the radial direction.

BRIEF DESCRIPTION OF THE DRAWINGS

FIG. 3(*b*) is a cross-sectional view showing how a sample is cut out of the radially anisotropic ring magnet of the present invention;

DETAILED DESCRIPTION OF THE PREFERRED EMBODIMENTS

Figure 1:
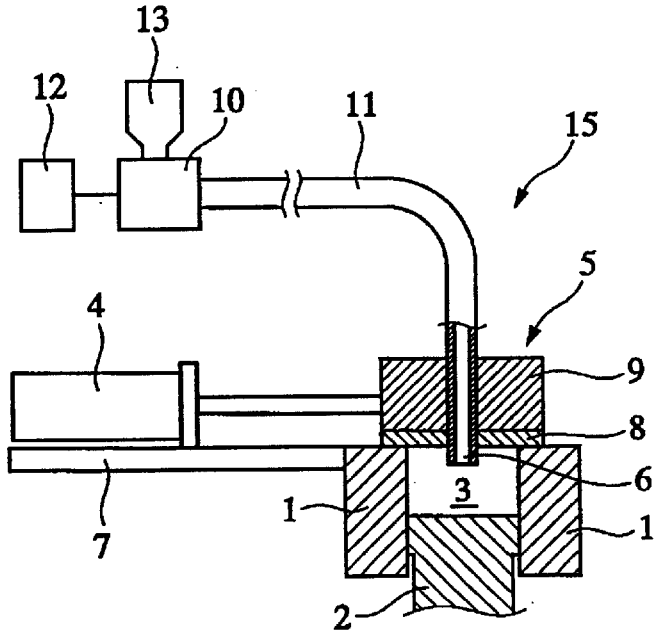
FIG. 1 is a cross-sectional view showing one example of a molding apparatus used in the present invention.

The inventors have investigated the use of organic substances comprising lipophilic groups constituted by hydrocarbon chains ($C_nH_m$) and polar groups such as —OH, —COOH, —COO—,>$NH_2$, etc. as lubricants for modifying a slurry. When fine R—Fe—B-based alloy powder is introduced into a liquid comprising a mineral oil, a synthetic oil or a vegetable oil and the above lubricant at a predetermined weight ratio to form a slurry, the polar group of the lubricant is attracted to the fine powder particles, and the lipophilic group of the lubricant functions as a protective film; The attraction force is originated from the electric attraction of the polar group, and there may be chemical attraction between the lubricant and the constituent elements of fine powder particles of R—Fe—B-based alloys in some cases.

Accordingly, it has been found that the intensity of attraction between the lubricant and the fine powder particles and the number of molecules attracted to the surface of the fine powder particles per unit area change depending on the types of polar groups, resulting in remarkable variation of the amount of carbon remaining in the sintered magnet after the degreasing process and the subsequent sintering process. Also, even if the lubricant has the same polar group, the amount of carbon remaining in the sintered magnet tends to increase as long as the lipophilic group has a large number of carbon atoms, because it increases the molecular weight of the lubricant per se and thus decreases the volatility of the lubricant.

Paying attention to the relations between the types of polar groups and lipophilic groups and the carbon content of the resultant R—Fe—B-based, sintered body, and the relations between the types of polar groups and lipophilic groups and the magnetic properties of the resultant R—Fe—B-based, sintered body, the inventors have investigated lubricants suitable for solving the above problems in detail. As a result, the inventors have found that a lubricant having a basic structure represented by the chemical formula of $R_1$—C(=O)—$OR_1$', wherein $R_1$ and $R_1$' are hydrocarbon groups, can extremely suppress increase in the carbon content of an R—Fe—B-based, sintered magnet, thereby providing the sintered magnet with high iHc, and also provide the green body with high strength suitable for mass production.

The polar group of the lubricant suitable for the present invention is limited to an ester bond (—COO—), and the number of carbon atoms in the lipophilic group of the lubricant is preferably 5–20. One or more —COO— groups may be contained in one molecule of the lubricant. The lipophilic group may contain two or more hydrocarbon chains ($C_nH_m$), wherein m and n are positive integer. When the number of carbon atoms in the lipophilic group is less than 5, sufficient lubrication cannot be obtained, resulting in difficulty in improving magnetic properties. On the other hand, when the number of carbon atoms in the lipophilic group is more than 20, the lubricant has an excessive molecular weight, resulting in increase in a boiling point and decrease in volatility. This leads to more than 0.1 weight % of carbon remaining in the sintered magnet, resulting in decrease in iHc. Or, by excess lubrication, the green body is provided with poor strength. The hydrocarbons in the lipophilic group may be saturated or unsaturated.

Specifically, the lubricant used in the present invention is at least one selected from the group consisting of esters of aliphatic acids and monovalent alcohols, esters of polybasic acids and monovalent alcohols, esters of aliphatic acids and polyvalent alcohols and their derivatives. The weight ratio of the lubricant added to the fine R—Fe—B-based alloy powder is preferably 0.01/99.99 to 0.5/99.5, more preferably 0.01/99.99 to 0.3/99.7. When the amount of the lubricant added is less than the above lower limit, enough effects cannot be obtained. On the other hand, when the amount of the lubricant added exceeds the above upper limit, the resultant sintered magnet has remarkably decreased iHc.

A weight ratio of the oil to the fine R—Fe—B-based alloy powder and the lubricant is not particularly restrictive. The oil need only be added in an amount that it covers all the surface of fine R—Fe—B-based alloy powder, that the fine R—Fe—B-based alloy powder and the can be well dispersed in the resultant slurry, and that the slurry is well oriented in a magnetic field.

The lubricant may be added to the coarse R—Fe—B-based alloy powder before pulverization to fine powder, or at a time when the slurry is prepared.

The lubricants, which can be used in the present invention, include esters of aliphatic acids and monovalent alcohols such as methyl caprate, methyl myristate, methyl laurate, methyl stearate, methyl oleate, and similar esters having butyl group, propyl group, ethylhexyl group in place of methyl group; esters of polybasic acids and monovalent alcohols such as dioleyl adipate, diisodecyl adipate, diisobutyl adipate, ditridecyl phthalate, 2-ethylhexyl phthalate, diisononyl phthalate, didecyl phthalate, diallyl phthalate, etc.; esters of aliphatic acids and polyvalent alcohols such as sorbitan trioleate, etc.; and their derivatives. Esters of aliphatic acids and monovalent alcohols and esters of polybasic acids and monovalent alcohols are slightly better than esters of aliphatic acids and polyvalent alcohols and their derivatives in improving the orientation of magnets.

In the sintered rare earth magnet of the present invention comprises an $R_2Fe_{14}B$-type intermetallic compound, wherein R is at least one of rare earth elements including Y, 50 atomic % or more of R being occupied by Nd, as a main phase, the main component composition of the sintered rare earth magnet is preferably 28–33 weight % of R, 0.8–1.5 weight % of B, 0–0.6 weight % of $M_1$, and 0–0.6 weight % of $M_2$, the balance being substantially Fe, wherein $M_1$ is at least one selected from the group consisting of Nb, Mo, W, V; Ta, Cr, Ti, Zr and Hf; $M_2$ is at least one selected from the group consisting of Al, Ga and Cu, and $R+B+Fe+M_1+M_2=100$ weight %.

The amount of R is preferably 28–33 weight %. To achieve good corrosion resistance, the amount of R is more preferably 28–32 weight %, most preferably 28–31 weight %. When the amount of R is less than 28 weight %, the desired iHc cannot be obtained. On the other hand, when the amount of R exceeds 33 weight %, the desired orientation cannot be obtained. To obtain the desired iHc and orientation, R is preferably Nd or Nd+Dy or Nd+Dy+Pr, and inevitable R components. When 50 atomic % or more of R is occupied by Nd, the amount of Dy is preferably 0.3–10 weight %. When 90 atomic % or more of R is occupied by Nd, the amount of Dy is more preferably 0.5–8 weight %. When less than 50 atomic % of R is occupied by Nd, the amount of Nd, which is abundant as a natural resource, is undesirably restricted. When the amount of Dy is less than 0.3 weight %, sufficient effects of adding Dy cannot be obtained. On the other hand, when the amount of Dy exceeds 10 weight %, Br decreases, resulting in failure to obtain the desired orientation.

The amount of B is preferably 0.8–1.5 weight %, more preferably 0.85–1.2 weight %. When the amount of B is less than 0.8 weight %, it is difficult to obtain iHc of 1.1 MA/m (14 kOe) or more. On the other hand, when the amount of B is more than 1.5 weight %, the desired orientation cannot be obtained.

The amount of a high-melting-point metal element $M_1$, which is at least one selected from the group consisting of Nb, Mo, W, V, Ta, Cr, Ti, Zr and Hf, is preferably 0.01–0.6 weight % to increase magnetic properties. With 0.01–0.6 weight % of $M_1$, the excess growth of main phase crystal grains is suppressed during the sintering process, thereby making it possible to stably achieve iHc of 1.1 MA/m (14 kOe) or more. However, when the $M_1$ content exceeds 0.6 weight %, the normal growth of main phase crystal grains is rather hindered, resulting in decrease in Br. On the other hand, when the $M_1$ content is less than 0.01 weight %, the effects of $M_1$ for improving magnetic properties cannot be obtained.

The amount of $M_2$, which is at least one selected from the group consisting of Al, Ga and Cu, is preferably 0.01–0.6 weight %. The inclusion of Al contributes to increase in iHc, resulting in improvement in corrosion resistance. When the amount of Al is more than 0.6 weight %, Br decreases drastically. On the other hand, when the amount of Al is less than 0.01 weight %, the effects of improving iHc and corrosion resistance cannot be obtained. The amount of Al is more preferably 0.05–0.3 weight %. The inclusion of Ga contributes to remarkably increase iHc. When the amount of Ga is more than 0.6 weight %, Br decreases drastically. On the other hand, when the amount of Ga is less than 0.01 weight %, the effects of improving iHc cannot be obtained The amount of Ga is more preferably 0.05–0.2 weight %. The inclusion of a trace amount of Cu contributes to improvement in corrosion resistance and increase in iHc. When the amount of Cu is more than 0.3 weight %, Br decreases drastically. On the other hand, when the amount of Cu is less than 0.01 weight %, the effects of improving corrosion resistance and iHc cannot be obtained. The amount of Cu is more preferably 0.05–0.3 weight %.

The inclusion of Co provides the sintered magnet with improved corrosion resistance and elevated Curie temperature, thereby improving the heat resistance of the sintered rare earth magnet. However, when the amount of Co exceeds 5 weight %, Fe—Co phases harmful to magnetic properties are formed, resulting in drastic decrease in Br and iHc. Accordingly, the amount of Co is preferably 5 weight % or less. On the other hand, when the amount of Co is less than 0.5 weight %, the effects of improving corrosion resistance and heat resistance cannot be obtained. Accordingly, the amount of Co is preferably 0.5–5 weight %.

With 0.5–5 weight % of Co and 0.01–0.3 weight % of Cu, the allowable temperature range of the second heat treatment is preferably widened to obtain iHc of 1.1 MA/m (14 kOe) or more at room temperature.

The inclusion of 0.01–0.3 weight % of Al contributes to improvement in coercivity, resulting in decrease in variation in coercivity due to uneven heat treatment temperature. Also, the inclusion of 0.01–0.08 weight % of Nb suppresses the formation of crystal grains in the sintering process, thereby suppressing the formation of coarse particles.

The amount of oxygen inevitably contained is preferably 0.3 weight % or less, more preferably 0.2 weight % or less, particularly preferably 0.18 weight % or less. With an oxygen content reduced to 0.3 weight % or less, the density of the sintered body can be increased to a level extremely close to the theoretical density. When an R—Fe—B-based, sintered magnet having an $R_2Fe_{14}B$-type intermetallic compound as a main phase, the sintering density of 7.56 g/cm$^3$ or more can be stably obtained. Further, by properly selecting the compositions of main components, the average particle size of fine powder and sintering temperature, etc., it is possible to achieve the sintering density of 7.58 g/cm$^3$ or more, flier 7.59 g/cm$^3$ or more.

The amount of carbon inevitably contained is preferably 0.10 weight % or less, more preferably 0.07 weight % or less. The reduction of a carbon content suppresses the formation of rare earth carbides, resulting in increase in iHc, $(BH)_{max}$, etc.

The amount of nitrogen inevitably contained is preferably 0.15 weight % or less. When the nitrogen content exceeds 0.15 weight %, Br decreases drastically. The sintered magnet of the present invention is provided with a known surface coating such as Ni plating, etc. for practical use, and good corrosion resistance is obtained particularly when the content of R is 28–32 weight % and the content of nitrogen is 0.002–0.15 weight %.

When the sintered magnet of the present invention is produced by a reduction diffusion method using Ca as a reducing agent, the content of Ca is preferably 0.1 weight % or less, more preferably 0.03 weight % or less, based on the total weight of the magnet to obtain the desired iHc and orientation.

In the sintered rare earth magnet comprising an $R'_2Fe_{14}B$-type intermetallic compound as a main phase, wherein R' is at least one of rare earth elements including Y, 50 atomic % or more of R' being occupied by Pr, its main component composition preferably comprises 28–33 weight % of R', 0.8–1.5 weight % of B, 0–0.6 weight % of $M_1$, and 0–0.6 weight % of $M_2$, the balance being Fe, wherein $M_1$ is at least one selected from the group consisting of Nb, Mo, W, V, Ta, Cr, Ti, Zr and Hf, $M_2$ is at least one selected from the group consisting of Al, Ga and Cu, and $R'+B+Fe+M_1+M_2=100$ weight %.

The amount of R' is preferably 28–33 weight %. To achieve good corrosion resistance, the amount of R' is more preferably 28–32 weight %, particularly preferably 28–31 weight %. When the amount of R' is less than 28 weight %, the desired iHc cannot be obtained. On the other hand, when the amount of R' exceeds 33 weight %, the desired orientation cannot be obtained. To obtain the desired iHc and orientation, R' is preferably Pr, Pr+Dy, or Nd+Dy+Pr, and inevitable R' components. Thus, when 50 atomic % or more of R' is occupied by Pr, the amount of Dy is preferably 0.3–10 weight %. When 90 atomic % or more of R' is occupied by Pr, the amount of Dy is more preferably 0.5–8%. When less than 50 atomic % of R' is occupied by Pr, there is remarkable rearrangement of spin near a liquid nitrogen temperature, resulting in drastic decrease in magnetic properties. When the amount of Dy is less than 0.3 weight %, sufficient effects of adding Dy cannot be obtained. On the other hand, when it exceeds 10 weight %, Br decreases, resulting in failure to obtain the desired orientation.

The reasons for limiting the amounts of B, $M_1$, $M_2$ and inevitable impurities are the same as above. When the $R'_2Fe_{14}B$-type intermetallic compound is a main phase, the sintered body has a density of 7.50 g/cm$^3$ or more, close to the theoretical density (7.54 g/cm$^3$) of the $Pr_2Fe_{14}B$-type intermetallic compound.

The rare earth, sintered magnet according to the present invention covers sintered magnets comprising $SmCo_5$ or $Sm_2TM_{17}$ as a main phase, wherein TM comprises Co, Fe, Cu and M', and M' is at least one selected from the group consisting of Zr, Hf, Ti and V.

In the production of the sintered rare earth magnet of the present invention, the fine pulverization of a starting alloy material can be carried out by dry pulverization by a jet mill, etc. in an inert gas, or by wet pulverization by a wet ball mill, etc. under non-oxidizing conditions.

After fine pulverization is carried out by a jet mill, etc. in an inert gas atmosphere having an oxygen concentration of 0.1% by volume or less, preferably 0.01% by volume or less, the fine powder is introduced from the inert gas atmosphere directly into non-oxidizing liquid comprising at least one oil selected from the group consisting of a mineral oil, a synthetic oil and a vegetable oil and a lubricant at a predetermined ratio to form a slurry without contact with the air. The average particle size of the fine powder is preferably 1–10 $\mu$m, more preferably 3–6 $\mu$m. When the average particle size is less than 1 $\mu$m, pulverization efficiency of the fine powder is extremely low. On the other hand, when it exceeds 10 $\mu$m, iHc and orientation are drastically decreased.

The slurry is molded in a magnetic field by a molding apparatus. To prevent the green body from having deteriorated magnetic properties due to oxidation, the green body is preferably kept in the above liquid immediately after molding to the removal of an oil.

If the green body is rapidly heated from room temperature to a sintering temperature, the inner temperature of the green body increases drastically, and the oil remaining in the green body reacts with rare earth elements to form rare earth carbides, resulting in deterioration in magnetic properties. Thus, it is preferable to carry out a degreasing treatment by heating the green body at a temperature of 100–500° C. and a vacuum degree of 13.3 Pa ($10^{-1}$ Torr) or less for 30 minutes or longer. By this degreasing treatment, the oil remaining in the green body is ally removed. Incidentally, as long as the degreasing treatment is within a temperature range of 100–500° C., it needs not be conducted by a single step, but may be conducted by a plurality of steps. Also, degreasing can be efficiently carried out, when a temperature-elevating speed from room temperature to 500° C. is preferably 10° C./minute or less, more preferably 5° C./minute or less.

From the aspect of degreasing and moldability, mineral oils, synthetic oils, vegetable oils or mixtures thereof preferably have fractional distillation points of 350° C. or lower. The kinetic viscosity of the oils at room temperature is preferably 10 cSt or less, more preferably 5 cSt or less.

The present invention will be described in further detail referring to the following examples without intention of limiting the scope of the present invention thereto.

EXAMPLE 1

A coarse R—Fe—B-based alloy powder comprising 23.1 weight % of Nd, 6.4 weight % of Pr, 1.0 weight % of Dy, 0.9 weight % of B, 2.0 weight % of Co, 0.1 weight % of Ga, and 0.1 weight % of Cu, the balance being Fe, was finely pulverized by a jet mill in a nitrogen gas atmosphere having an oxygen concentration of 10 ppm or less by volume. The resultant fine powder having an average particle size of 4.0 gm was directly introduced into a mineral oil (tradename "Idemitsu Supper Sol PA-30" available from Idemitsu Kosan Co., Ltd.) in a nitrogen gas atmosphere without contact with the air, to form a slurry. The average particle size was measured by a laser diffraction-type apparatus for measuring particle size distribution (tradename "HEROS & RODOS" available from Sympatec). The resultant slurry was mixed with methyl oleate by a stirrer in a predetermined formulation that the fine powder was 70 parts by weight, the mineral oil was 29.9 parts by weight, and methyl oleate was 0.10 parts by weight.

This slurry was charged into a cavity of a molding die to carry out compression molding under the conditions of a transverse orienting magnetic field having an intensity of 1.0 MA/m (13 kOe) and molding pressure of 98 MPa (1.0 ton/cm$^2$), thereby producing a rectangular parallelepiped green body of 15 mm×25 mm×10 mm with anisotropy in a direction in parallel with the 10-mm side.

The green body was set at a jig of a three-point bending test machine with two surfaces of 15 mm×25 mm of the green body arranged horizontally, and pressure was applied to the green body in parallel with the 10-mm side to measure three-point bending strength at room temperature. The measurement results are shown in Table 1.

Another green body molded in the same manner was heated at 200° C. for 3 hours at a vacuum degree of about 66.5 Pa ($5\times10^{-1}$ Torr) to remove the oil. It was then heated to 1050° C., kept at 1050° C. for 2 hours in the same atmosphere to conduct sintering, and then cooled to room temperature in this order. The resultant sintered body was subjected to a first heat treatment comprising heating at 900° C. for 2 hours in an Ar atmosphere, and then quenching to room temperature, and then to a second heat treatment comprising heating at 480° C. for 1 hour in an Ar atmosphere, and then cooling to room temperature, to obtain a cubic, R—Fe—B-based, sintered magnet of about 10 mm each. The resultant sintered magnet was machined to a cubic shape of 7 mm each as a sample for the measurement of magnetic properties.

With a pulse magnetic field of 11.9 MA/m (150 kOe) applied to each sample in parallel with a magnetic anisotropy-providing direction at room temperature (20° C.), the maximum magnetization ($4\pi I_{max}$) of each sample was measured to evaluate an orientation defined by $Br/4\pi I_{max}$. The measurement results are shown in Table 1.

The analyzed content of carbon in each sintered magnet is also shown in Table 1.

EXAMPLES 2–4

Three types of slurries were produced in the same manner as in EXAMPLE 1 except for adding methyl stearate, diisodecyl adipate and 2-ethylhexyl stearate, respectively, instead of methyl oleate. R—Fe—B-based, sintered magnets were produced and evaluated in the same manner as in EXAMPLE 1 except for using the above slurries. The measurement results are shown in Table 1.

COMPARATIVE EXAMPLE 1

An R-T-B-based, sintered magnet was produced and evaluated in the same manner as in EXAMPLE 1 except for using a slurry comprising the fine R—Fe—B alloy powder of EXAMPLE 1 and a mineral oil without methyl oleate. The measurement results are shown in Table 1.

COMPARATIVE EXAMPLE 2

An R—Fe—B-based, sintered magnet was produced and evaluated in the same manner as in EXAMPLE 1 except for adding 0.1 parts by weight of oleyl alcohol to the slurry instead of methyl oleate. The measurement results are shown in Table 1.

COMPARATIVE EXAMPLE 3

An R—Fe—B-based, sintered magnet was produced and evaluated in the same manner as in EXAMPLE 1 except for adding 0.1 parts by weight of oleylamine to the slurry instead of methyl oleate. The measurement results are shown in Table 1.

COMPARATIVE EXAMPLE 4

An R—Fe—B-based, sintered magnet was produced and evaluated in the same manner as in EXAMPLE 1 except for adding 0.1 parts by weight of methyl acetate to the slurry instead of methyl oleate. The measurement results are shown in Table 1.

COMPARATIVE EXAMPLE 5

An R—Fe—B-based, sintered magnet was produced and evaluated in the same manner as in EXAMPLE 1 except for adding 0.1 parts by weight of methyl behenate to the slurry instead of methyl oleate. The measurement results are shown in Table 1.

TABLE 1

| No. | Lubricant | Number of Carbon Atoms in Lipophilic Group | $Br/4\pi I_{max}$ (%) | $(BH)_{max}$ (kJ/m$^3$) (MGOe) | iHc (MA/m) (kOe) | Carbon Content in Sintered Body (wt. %) | Bending Strength of Green Body (MPa) |
|---|---|---|---|---|---|---|---|
| EX. 1 | Methyl Oleate | 17 | 96.5 | 395<br>49.4 | 1.23<br>15.4 | 0.067 | 0.81 |
| EX. 2 | Methyl Stearate | 17 | 96.2 | 391<br>49.1 | 1.23<br>15.4 | 0.067 | 0.81 |
| EX. 3 | Diisodecyl Adipate | 20 | 96.7 | 394<br>49.5 | 1.23<br>15.5 | 0.067 | 0.79 |
| EX. 4 | 2-Ethylhexyl Stearate | 25 | 96.4 | 392<br>49.2 | 1.22<br>15.3 | 0.068 | 0.79 |
| COM. EX. 1 | None | — | 95.1 | 377<br>47.4 | 1.23<br>15.5 | 0.065 | 1.34 |
| COM. | Oleyl Alcohol | 17 | 96.3 | 390 | 1.17 | 0.088 | 0.34 |

TABLE 1-continued

| No. | Lubricant | Number of Carbon Atoms in Lipophilic Group | $Br/4\pi I_{max}$ (%) | $(BH)_{max}$ ($kJ/m^3$) (MGOe) | iHc (MA/m) (kOe) | Carbon Content in Sintered Body (wt. %) | Bending Strength of Green Body (MPa) |
|---|---|---|---|---|---|---|---|
| EX. 2 | | | | 49.0 | 14.7 | | |
| COM. | Oleylamine | 17 | 96.0 | 389 | 1.15 | 0.089 | 0.37 |
| EX. 3 | | | | 48.9 | 14.4 | | |
| COM. | Methyl Acetate | 1 | 95.2 | 379 | 1.23 | 0.066 | — |
| EX. 4 | | | | 47.6 | 15.5 | | |
| COM. | Methyl | 22 | 96.8 | 395 | 1.14 | 0.093 | — |
| EX. 5 | Behenate | | | 49.6 | 14.3 | | |

The green body of EXAMPLE 1 was slightly lower in strength than that of COMPARATIVE EXAMPLE 1 (free from lubricant), though the strength of EXAMPLE 1 was satisfactory in terms of industrial production.

Methyl oleate used in EXAMPLE 1, oleyl alcohol used in COMPARATIVE EXAMPLE 2 and oleylamine used in COMPARATIVE EXAMPLE 3 have the same lipophilic group having 17 carbon atoms and differ from each other only in polar groups (—COO—, —OH, $>NH_2$). It is cleared from EXAMPLE 1 and COMPARATIVE EXAMPLES 2 and 3 that the bending strength of the green bodies depends on the types of polar groups in the lubricants. With respect to magnet properties, though EXAMPLE 1 and COMPARATIVE EXAMPLES 2 and 3 showed substantially the same orientation ($Br/4\pi I_{max}$), EXAMPLE 1 showed higher iHc than COMPARATIVE EXAMPLES 2 and 3. Further, the facts that the carbon contents of the sintered magnets increased due to the lubricants remaining after sintering, and that the degree of decrease in iHc of the sintered bodies varied depending on the carbon contents of the sintered magnets, verify that the carbon contents of the sintered magnets depend on the types of polar groups in the lubricants.

The lubricants used in COMPARATIVE EXAMPLES 4 and 5 had a common polar group of —COO— and lipophilic groups having hydrocarbon chains with different numbers of carbon atoms. Because it is clear from the results of COMPARATIVE EXAMPLE 4 that there is no improvement in the orientation ($Br/4\pi I_{max}$) appreciated in the case of a short hydrocarbon chain, a lubricant having short hydrocarbon chains does not appear to contribute to improving the lubrication of the fine powder. On the other hand, COMPARATIVE EXAMPLES indicates that though there is improvement in the orientation ($Br/4\pi I_{max}$) in the case of a long hydrocarbon chain, the long hydrocarbon chain leads to increase in the carbon content in the resultant sintered body, resulting in drastic decrease in iHc.

EXAMPLE 5

Coarse powder (under 320 mesh) of an R—Fe—B-based alloy having a main component composition comprising 23.1 weight % of Nd, 6.4 weight % of Pr, 1.0 weight % of Dy, 1.05 weight % of B, 0.08 weight % of Ga, 0.2 weight % of Nb, 0.05 weight % of Al, 0.13 weight % of Cu, 2.0 weight % of Co, the balance being Fe, was pulverized to fine powder having an average particle size of 3.8 $\mu$m by a jet mill in a nitrogen atmosphere having an oxygen concentration of less than 1 ppm by volume. A slurry was formed in the same manner as in EXAMPLE 1 except for using the above fine powder. The resultant slurry was charged into a cavity 29 of a molding die 20 shown in FIG. 2, and molded at molding pressure of 78.4 MPa (0.8 ton/$cm^2$) and a pulse magnetic field of 100 V to produce a green body with polar anisotropy.

Figure 6:
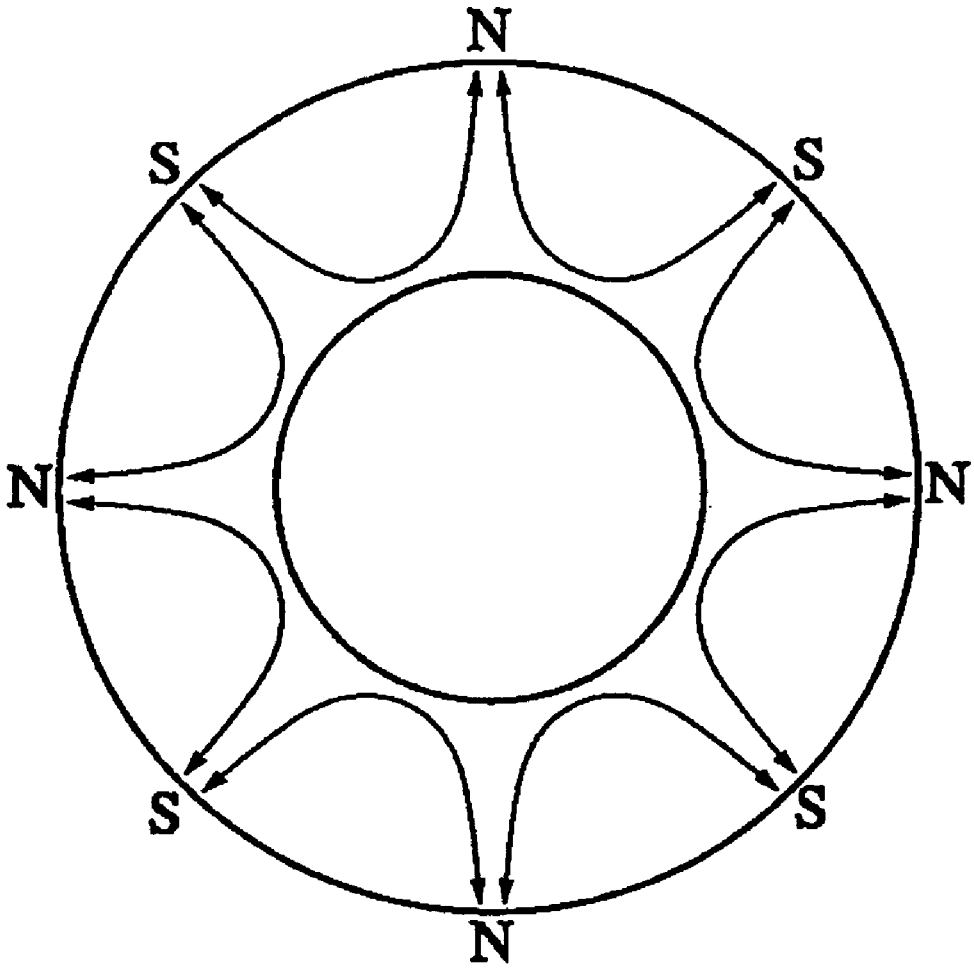
FIG. 6 is a schematic view showing one example of the ring magnet of the present invention having polar anisotropy.

The green body was heated at 200° C. for 1 hour at a vacuum degree of about 66.5 Pa ($5\times10^{-1}$ Torr) for degreasing. It was then sintered at 1060° C. for 2 hours at a vacuum degree of about $4.0\times10^{-3}$ Pa (about $3\times10^{-5}$ Torr), and then cooled to room temperature. The resultant sintered body was subjected to a heat treatment comprising heating at 900° C. for 1 hour in an Ar atmosphere, cooling to 550° C., keeping at 550° C. for 2 hours, and then cooling to room temperature. After machining the heat-treated, sintered magnet to a predetermined size, an epoxy resin coating was applied to the sintered body at an average thickness of 12 $\mu$m by an electrodeposition method, to provide a polar anisotropic ring magnet with eight magnetic poles having an outer diameter of 48 mm, an inner diameter of 30 mm and a height of 11 mm as shown in FIG. 6.

The polar anisotropic ring magnet was measured with respect to a surface magnetic flux density Bo at magnetic poles.

To measure the X-ray diffraction of the above polar anisotropic ring magnet on an outer surface at a middle point between magnetic poles, a sample was cut out from the ring magnet and set in an apparatus for X-ray diffraction measurement (RU-200BK, available from Rigaki Denki K. K.) by a 2θ-θ scanning method. CuKα1 ray (λ=0.15405 nm) was used as an X-ray source. Noises (back ground) were removed using software stored in the apparatus. Main diffraction peaks were obtained from a (004) plane at 2θ=29.080, a (105) plane at 2θ=38.06°, and a (006) plane at 2θ44.34° in the $R_2T_{14}B$-type intermetallic compound as a main phase. Assuming that the intensity I (106) of an X-ray diffraction peak from a (006) plane was 100%, I (004)/1 (006)=0.33, and I (105)/I (006)=0.63. The results are shown in Table 2.

COMPARATIVE EXAMPLE 6

A polar anisotropic ring magnet was produced in the same manner as in EXAMPLE 5 except for molding the slurry of COMPARATIVE EXAMPLE 1 instead of the slurry of EXAMPLE 5 in a magnetic field in a polar anisotropic direction. The resultant polar anisotropic ring magnet was measured with respect to a surface magnetic flux density Bo at magnetic poles and X-ray diffraction in the same manner as in EXAMPLE 5. The results are shown in Table 2. Though main diffraction peaks of COMPARATIVE EXAMPLE 6 were the same as those of EXAMPLE 5, I (004)/I(006) was 0.32, and I(105)/I(006) was 0.96. The polar anisotropic ring magnet contained 0.13 weight % of oxygen, 0.05 weight % of carbon, and 0.003 weight % of nitrogen.

TABLE 2

| No. | Density (g/cm$^3$) | Bo (T) | Bo (kG) | I (105)/I (006) |
|---|---|---|---|---|
| EX. 5 | 7.59 | 5.80 | 58.0 | 0.63 |
| COM. EX. 6 | 7.59 | 5.48 | 54.8 | 0.96 |

Note:
Bo is a surface magnetic flux density measured at magnetic poles.

As is clear from the results of EXAMPLE 5 and COMPARATIVE EXAMPLE 6 shown in Table 2, the present invention can provide a polar anisotropic ring magnet having a density of 7.56 g/cm$^3$ or more, the ratio of I(105)/I (006) being 0.5–0.8, wherein I (105) and I (006) represent the intensity of X-ray diffraction peaks with respect to (105) and (106) planes, respectively, in an X-ray diffraction measured at a middle position between magnetic poles on an outer surface of the ring magnet.

EXAMPLE 6

Figure 2:
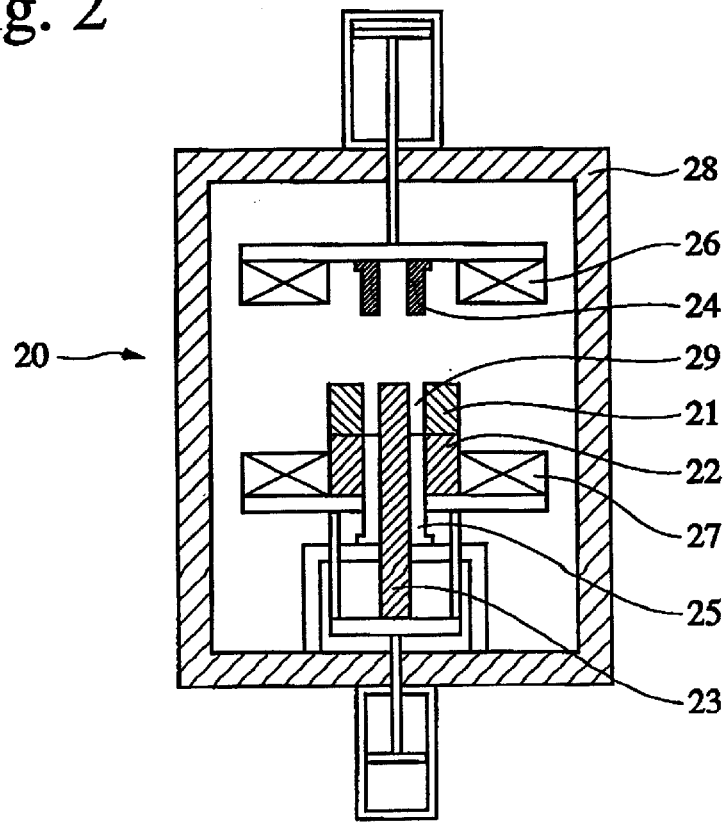
FIG. 2 is a cross-sectional view showing another example of a molding apparatus used in the present invention.

A slurry produced in the same manner as in EXAMPLE 1 was charged into a cavity 29 (inner diameters of dies 21 and 22: 60 mm, outer diameter of a core 23: 45 mm, length of a ferromagnetic die part 21: 34 mm, and charge depth: 34 mm) of a molding die 20 shown in FIG. 2, and molded in a radially unidirectional magnetic field of about 238.7 kA/m (3 kOe) under molding pressure of 78.4 MPa (0.8 ton/cm$^2$). The resultant green body was then subjected to the same treatment as in EXAMPLE 5 to produce a ring magnet having two radially opposite poles.

Figure 3A:
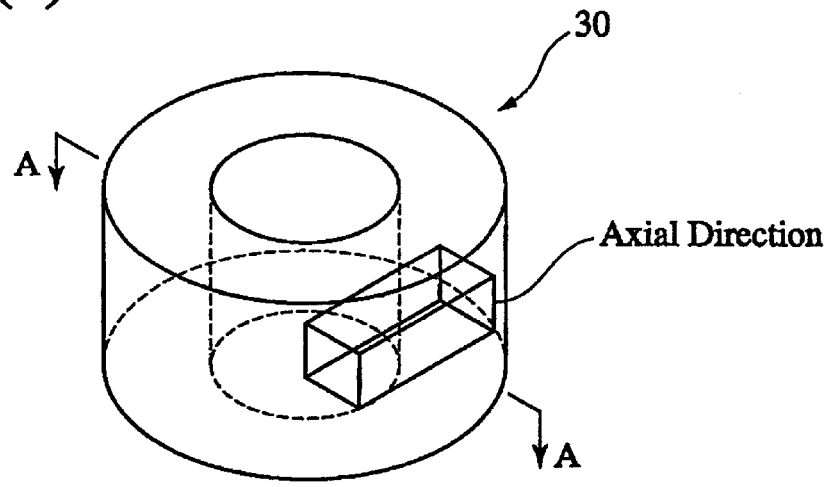
FIG. 3(*a*) is a perspective view showing how a sample is cut out of the radially anisotropic ring magnet of the present invention.
Figure 3B:
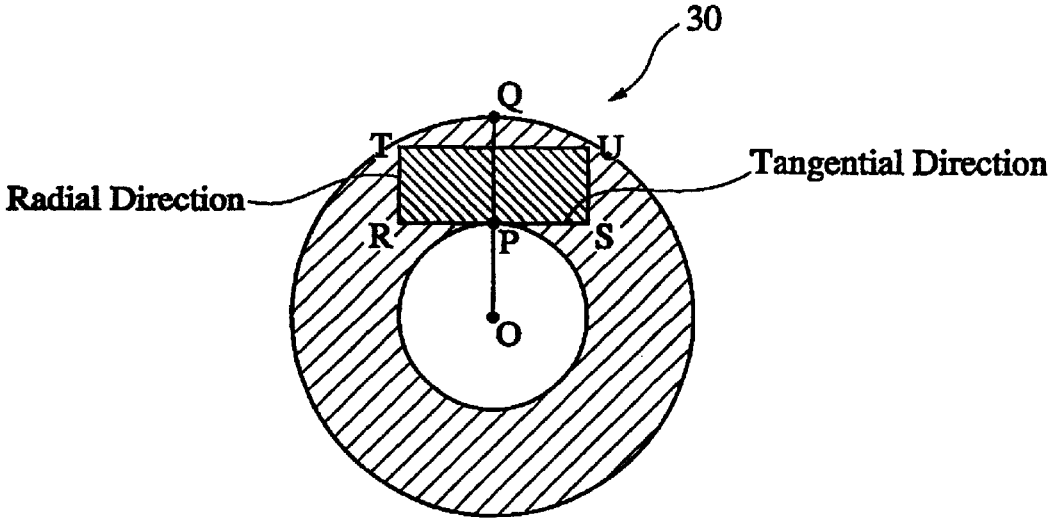

As is shown in FIG. 3, the above radially bipolar ring magnet 30 was cut along an orientation direction to obtain a rectangular parallelepiped magnet piece of 5 mm in a tangent direction, 6.5 mm in a longitudinal direction and 2.8 mm in a radial direction.

How the rectangular parallelepiped magnet piece was cut out will be explained referring to FIG. 3 (*b*). A line OPQ was drawn in a radial direction from a center point O of the radially bipolar ring magnet 30 in perpendicular to the orientation direction. A point P was a contact point with an inner surface, and a point Q was a contact point with an outer surface. A tangent line RPS was drawn at the contact point P such that the tangent line RPS was as long as 5 mm from the contact point P as a center. A 2.8-mm-long line RT and a 2.8-mm-long line SU were drawn in perpendicular to the tangent line RPS. A 5-mm-long line TU was then drawn in parallel with the tangent line RPS. The direction of RPS and the direction of TU in a rectangle RSUT correspond to the direction of a tangent line in the radially bipolar ring magnet 30. Accordingly, the direction of TU and the direction of SU are defined as the orientation direction of the radially bipolar ring magnet 30.

The magnet piece was cut out at a thickness of 6.5 mm along the longitudinal direction of the radially bipolar ring magnet 30. After four rectangular parallelepiped magnet pieces were cut out by this method, they were bonded with their directions aligned to provide a rectangular parallelepiped magnet sample. The resultant rectangular parallelepiped magnet sample was measured with respect to the following magnetic properties.

When a rectangular parallelepiped magnet piece of the above dimension could not be cut out from the radially bipolar ring magnet, a plurality of rectangular parallelepiped magnet pieces were cut out according to the above cutting method except for different dimensions, and the magnet pieces were bonded to each other to the desired dimensions with their directions aligned.

The rectangular parallelepiped magnet sample was measured with respect to a residual magnetic flux density Br// in an orientation direction, a coercivity iHc, a maximum energy product $(BH)_{max}$ and a squareness ratio Hk/iHc at room temperature (20° C.). Hk is the value of H corresponding to 0.9 Br in the second quadrant of a 4πI-H curve, wherein 4πI is the intensity of magnetization, and H is the intensity of a magnetic field. The squareness ratio Hk/iHc indicates the rectangularity of the 4πI-H demagnetization curve. After measuring the residual magnetic flux density Br⊥ of the rectangular parallelepiped magnet sample in a longitudinal direction at room temperature (20° C.), the orientation of the radially bipolar ring magnet defined by [(Br//)/(Br//+Br⊥)]×100(%) was calculated. The density of the radially bipolar ring magnet was also measured. The measurement results are shown in Table 3. The radially bipolar ring magnet contained 0.13 weight % of oxygen, 0.05 weight % of carbon, and 0.003 weight % of nitrogen.

COMPARATIVE EXAMPLE 7

A radially bipolar ring magnet was produced and evaluated in the same manner as in EXAMPLE 6 except for molding the slurry of COMPARATIVE EXAMPLE 1 instead of the slurry of EXAMPLE 5 in an orienting magnetic field. The results are shown in Table 3.

TABLE 3

| No. | Density (g/cm$^3$) | Br// (T) (kG) | iHc (MA/m) (kOe) | $(BH)_{max}$ (kJ/m$^3$) (MGOe) | Hk/iHc (%) | Orientation (%) |
|---|---|---|---|---|---|---|
| EX. 6 | 7.60 | 1.35<br>13.5 | 1.27<br>16.0 | 353.3<br>44.4 | 96.4 | 92.3 |
| COM. EX. 7 | 7.60 | 1.31<br>13.1 | 1.31<br>16.5 | 319.9<br>40.2 | 87.1 | 89.4 |

As is clear from the data of EXAMPLE 6 and COMPARATIVE EXAMPLE 7 in Table 3, the present invention can provide a radially bipolar ring magnet having a density of 7.56 g/cm$^3$ or more, Br//(orientation direction) of 1.25 T (12.5 kG) or more, iHc of 1.1 MA/m (14.0 kOe) or more, $(BH)_{max}$ of 282.6 kJ/m$^3$ (35.5 MGOe) or more, Hk/iHc of 87.5% or more, and the degree of orientation of 85.5% or more in an orientation direction, higher than the magnetic properties of the conventional magnets.

EXAMPLE 7

The slurry prepared in the same manner as in EXAMPLE 1 was charged into a tank 13 of a slurry-supplying apparatus 15 shown in FIG. 1. A slurry-supplying pipe 6 was lowered by a cylinder (not shown) and stopped at a position near a bottom surface of an arc-segment-shaped cavity 3 (at a position near an upper surface of a lower punch 2). While the slurry-supplying pipe 6 was elevated by a cylinder (not shown) to an upper end of the cavity 3, a pump 10 was operated to send a predetermined amount of a slurry from the tank 13 through the pipe 11 to the slurry-supplying pipe 6 and then to the cavity 3. After withdrawing the slurry-supplying pipe 6 from the cavity 3, the supply head 9 was moved leftward by a cylinder 4. While applying an orientation magnetic field of 1.0 MA/m (13 kOe) horizontally, compression molding in a transverse magnetic field was carried out under pressure of 98 MPa (1 ton/cm$^2$) between an upper punch (not shown) and a lower punch 2, to form an arc segment green body. The green body was then degreased, sintered, and heat-treated in the same manner as in EXAMPLE 1.

Figure 4:
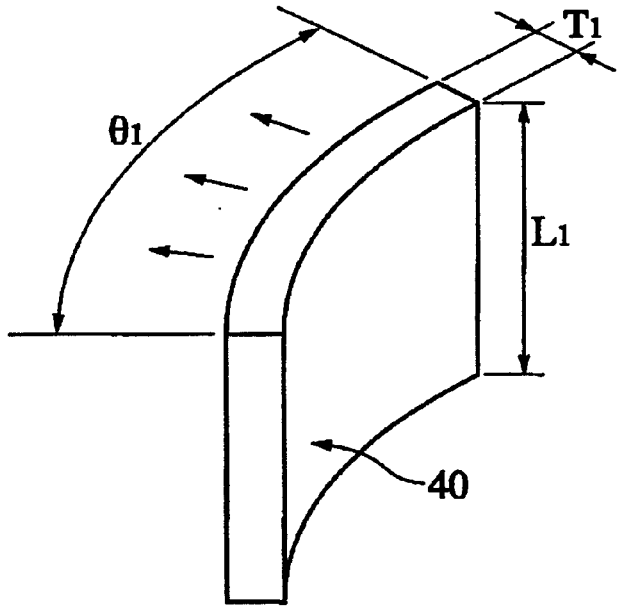
FIG. 4 is a perspective view showing one example of the arc segment magnet of the present invention having parallel anisotropy.

The resistant sintered magnet was machined until an as-sintered surface was removed from the sintered magnet, and then coated with an epoxy resin at an average thickness of 15 $\mu$m to provide a thin, long, R—Fe—B-based, sintered arc segment magnet 40 (thickness $T_1$=2.8 mm, length $L_1$=80.0 mm, and center angle $\theta_1$=45°) as shown in FIG. 4. The sintered magnet before working was warped by as little as less than 1 mm in an $L_1$ direction, with good degree of orientation ($Br/4\pi I_{max}$) in an anisotropy direction. The sintered arc segment magnet 40 was provided with anisotropy in a direction indicated by ↑ (direction substantially in parallel with a paper surface). Samples were cut out from the arc segment magnet 40 to measure their magnetic properties in a magnetic anisotropy direction at room temperature (20° C.). As a result, the sintered magnet samples had a degree of orientation ($Br/4\pi I_{max}$) as high as 96.8%, iHc as high as 1.24 MA/m (15.6 kOe) and $(BH)_{max}$ as high as 394.8 kJ/m$^3$ (49.6 MGOe). The sintered magnet samples also had a density of 7.60 g/cm$^3$, an oxygen content of 0.14 weight %, a carbon content of 0.05 weight %, and a nitrogen content of 0.02 weight %.

The sample was set in an apparatus for measuring X-ray diffraction (RU-200BH, available from Rigaku Denki K. K.) using CuKα1 ray having λ of 0.15405 nm, to measure its X-ray diffraction by a 2θ-θ scanning method. As a result, main diffraction peaks were at 2θ=29.08°, 38.06° and 44.34° corresponding to (004), (105) and (006) planes, respectively, of an $R_2T_{14}B$-type intermetallic compound, a main phase of the sintered magnet. I (105)/I (006) was 0.66, assuming that the X-ray diffraction peak intensity I (006) of the (006) plane was 100%.

EXAMPLE 8

Thin, long, sintered arc segment magnets having length $L_1$, thickness $T_1$, and $\theta_1$ shown in Table 4 were produced in the same manner as in EXAMPLE 7 except for changing the thickness of the cavity 3 and the amount of a slurry charged. These magnets had high magnetic properties such as orientation ($Br/4\pi I_{max}$) of 96.4–96.7% in a magnetic anisotropy direction, IHc of 1.23–1.25 MA/m (15.4–15.7 kOe), and $(BH)_{max}$ of 393.2–395.6 kJ/m$^3$ (49.4–49.7 MGOe), as well as a density of 7.60 g/cm$^3$, an oxygen content of 0.13–0.14 weight %, a carbon content of 0.06 weight %, and a nitrogen content of 0.02–0.03 weight %. X-ray diffraction measured in the same manner as in EXAMPLE 7 revealed that I (105)/I (006) was 0.67–0.68.

COMPARATIVE EXAMPLE 8

Though green bodies for R—Fe—B-based, sintered arc segment magnets having T=1.0–4.0 mm were tried to be molded in a transverse magnetic field in the same manner as in EXAMPLE 8 except for using the slurry of COMPARATIVE EXAMPLE 1 as a molding material, cracking occurred in the green bodies, failing to produce good green bodies free from cracks.

TABLE 4

| No. | $L_1$ (mm) | $T_1$ (mm) | $\theta_1$ (°) |
|---|---|---|---|
| EXAMPLE 8 | 72 | 1.0 | 55 |

TABLE 4-continued

| No. | $L_1$ (mm) | $T_1$ (mm) | $\theta_1$ (°) |
|---|---|---|---|
| | | 2.1 | |
| | | 4.0 | |

EXAMPLE 9

Figure 5:
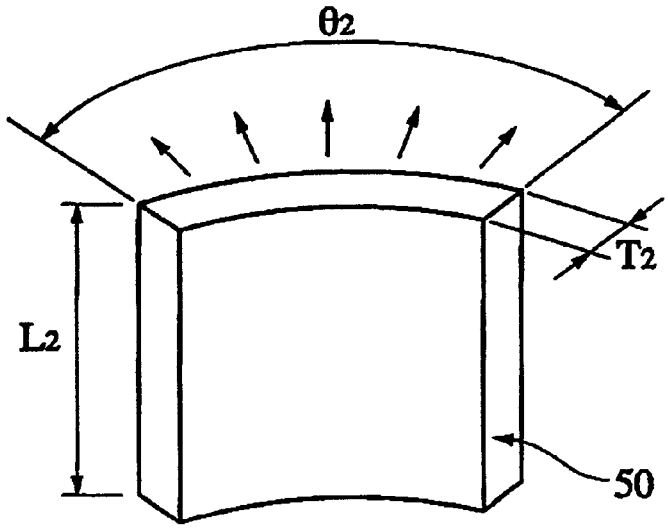
FIG. 5 is a perspective view showing one example of the arc segment magnet of the present invention having radial anisotropy.

With radially anisotropic green bodies for sintered arc segment magnets having varied inner diameters and with varied strength of a radially orienting magnetic field (Hap), sintered arc segment magnets 50 having the dimension shown in FIG. 5 (length $L_2$:65 mm, thickness $T_2$:2.5 mm, $\theta_2$:40° and inner diameters: shown in Table 5) were produced to investigate the relations of inner diameter, Hap and the degree of orientation (%) in a radial direction. The results are shown in Table 5.

Each of these sintered arc segment magnets was produced in the same manner as in EXAMPLE 7 except for changing molding conditions and the dimension of each green body. The production process comprised degreasing, sintering, heat treatment, machining and surface treatment. It is clear from Table 5 that the resultant sintered arc segment magnets had a high degree of orientation in a radial direction. Any arc segment magnets shown in Table 5 had a squareness ratio Hk/iHc of more than 87.5%, iHc of more than 1.1 MA/m(14 kOe), an oxygen content of 0.13–0.14 weight %, a carbon content of 0.05–0.06 weight %, and a nitrogen content of 0.003–0.004 weight %.

COMPARATIVE EXAMPLE 9

Though green bodies for sintered arc segment magnets having the same shape as in EXAMPLE 9 were tried to be molded using the slurry of COMPARATIVE EXAMPLE 1 as a molding material, cracking occurred in the green bodies, failing to produce sintered arc segment magnets.

TABLE 5

| Inner Diameter of Arc | Hap | | Orientation |
|---|---|---|---|
| Segment (mm) | (kA/m) | (kOe) | (%) |
| 100 | 708.3 | 8.9 | 92.6 |
| 50 | 612.8 | 7.7 | 92.2 |
| 30 | 461.6 | 5.8 | 91.9 |
| 10 | 310.4 | 3.9 | 91.7 |

EXAMPLE 10

Coarse powder (under 320 mesh) of an R-T-B-based alloy having a main component composition comprising 21.4 weight % of Nd, 6.0 weight % of Pr, 3.1 weight % of Dy, 1.05 weight % of B, 0.08 weight % of Ga, 0.2 weight % Nb, 0.05 weight % of Al, 0.13 weight % of CGu, and 2.0 weight % of Co, the balance being Fe, was pulverized by a jet mill in an Ar atmosphere having an oxygen concentration of less than 1 ppm by volume. A slurry was formed in the same manner as in EXAMPLE 1 except for using the resultant fine powder having an average particle size of 3.8 mm.

The resultant slurry was charged into a cavity 29 (inner diameter of dies 21 and 22: 60 mm, outer diameter of a core 23: 45 mm, length of ferromagnetic die part 21 34 mm, and charge depth: 34 mm) of a molding die 20 shown in FIG. 2, to carry out molding in a radial orientation magnetic field of about 238.7 kA/m (3 kOe) under molding pressure of 78.4 MPa (0.8 ton/cm$^2$) to produce a green body.

The resultant green body was heated at 200° C. for 1 hour at a vacuum degree of about 66.5 Pa ($5\times10^{-1}$ Torr) for degreasing. It was then sintered at 1060° C. for 2 hours at a vacuum degree of about $4.0\times10^{-3}$ Pa ($3\times10^{-5}$ Torr), and then cooled to room temperature. The resultant sintered body was subjected to a heat treatment comprising heating at 900° C. for 1 hour in an Ar atmosphere, cooling to 550° C., keeping at 550° C. for 2 hours, and then cooling to room temperature. After machining the heat-treated, sintered magnet to a predetermined size, an epoxy resin coating was applied to the sintered body at an average thickness of 12 $\mu$m by an electrodeposition method, to provide a radially anisotropic ring magnet of 48 mm in outer diameter, 39 mm in inner diameter and 11 mm in height.

As shown in FIG. 3, a rectangular parallelepiped magnet sample of 5 mm in a tangential direction, 6.5 mm in an axial direction and 2.8 mm in a radial direction was cut out of the radially anisotropic ring magnet 30 at an arbitrary position by a method shown in FIG. 3 (*b*) in the same manner as in EXAMPLE 6

The rectangular parallelepiped magnet sample was measured with respect to a residual magnetic flux density Br// in a radial direction, a coercivity iHc, a maximum energy product $(BH)_{max}$ and a squareness ratio Hk/iHc at room temperature (20° C). After measuring the residual magnetic flux density Br⊥ of the rectangular parallelepiped magnet sample in an longitudinal direction at room temperature (20° C.), the orientation of the radially anisotropic ring magnet defined by [(Br//)/(Br//+Br⊥)]×100(%) was calculated. The density of the radially anisotropic ring magnet was also measured. The radially anisotropic ring magnet contained 0.13 weight % of oxygen, 0.05 weight % of carbon and 0.003 weight % of nitrogen.

COMPARATIVE EXAMPLE 10

A radially anisotropic ring magnet was produced and evaluated in the same manner as in EXAMPLE 5 except for molding the slurry of COMPARATIVE EXAMPLE 1 instead of the slurry of EXAMPLE 10 in a radial magnetic field. The results are shown in Table 6.

TABLE 6

| No. | Density (g/cm$^3$) | Br// (T) (kG) | iHc (MA/m) (kOe) | $(BH)_{max}$ (kJ/m$^3$) (MGOe) | Hk/iHc (%) | Orientation (%) |
|---|---|---|---|---|---|---|
| EX. 10 | 7.61 | 1.30<br>13.0 | 1.43<br>18.0 | 318.4<br>40.0 | 96.4 | 89.9 |
| COM. EX. 10 | 7.61 | 1.23<br>12.3 | 1.43<br>18.0 | 281.0<br>35.3 | 87.1 | 85.2 |

As is clear from the data of EXAMPLES 10 and COMPARATIVE EXAMPLES 10 in Table 6, the present invention can provide radially anisotropic ring magnets have much higher magnetic properties than those of the conventional radially anisotropic ring magnets, specifically a density of 7.56 g/cm$^3$ or more, Br// in a radial direction of 1.25 T (12.5 kG) or more, iHc of 1.1 MA/m (14 kOe) or more, $(BH)_{max}$ of 282.6 kJ/m$^3$ (35.5 MGOe) or more, Hk/iHc of 87.5% or more, and a degree of orientation in a radial direction of 85.5% or more.

EXAMPLE 11

With various dimensions of dies 21, 22 and a core 23 in a molding machine 20 shown in FIG. 2, radially anisotropic, ring-shaped green bodies having various inner diameter dimensions were produced, to investigate the relations of radial orientation magnetic field strength (flap) and the inner diameters and the degree of orientation (%) in a radial direction of the resultant radially anisotropic ring magnets. As shown in Table 7, Hap decreased as the inner diameter of the radially anisotropic, ring-shaped green body decreased. The upper limit of Hap was 716.2 kA/m (9 kOe) due to heat generation from a power supply for generating a magnetic field and a coil, when the inner diameter of the radially anisotropic ring magnet was 100 mm.

Degreasing, sintering, heat treatment, machining and surface treatment were conducted in this order in the same manner as in EXAMPLE 5 except for changing the inner and outer diameters of a ring-shaped green body [outer diameter=inner diameter+(8–20 mm)] and Hap, to form a radially anisotropic ring magnet having an inner diameter shown in Table 7.

Any of radially anisotropic ring magnets shown in Table 7 had high radial orientation. Also, any radially anisotropic ring magnets had a squareness ratio Hk/iHc of more than 87.5% and iHc of more than 1.1 MA/m (14.0 kOe). The radially anisotropic ring magnet contained 0.14–0.16 weight % of oxygen, 0.04–0.05 weight % of carbon and 0.003–0.004 weight % of nitrogen.

COMPARATIVE EXAMPLE 11

Radially anisotropic ring magnet shown in Table 7 were produced in the same manner as in EXAMPLE 11 except for using the slurry of COMPARATIVE EXAMPLE 1 to measure their radial orientation.

TABLE 7

| Hap (kA/m) (kOe) | Inner Diameter of Radially Anisotropic Ring Magnet (mm) | Orientation (%) EX. 11 | Orientation (%) COM. EX. 11 |
|---|---|---|---|
| 716.2<br>9 | 100 | 92.9 | 85.3 |
| 636.6<br>8 | 50 | 92.7 | 85.1 |
| 453.6<br>5.7 | 30 | 91.7 | 85.0 |
| 270.6<br>3.4 | 10 | 90.1 | 84.9 |

It is clear from Table 7 that the present invention can produce high-performance, radially anisotropic ring magnets of 100 mm or less in inner diameter, which are superior to the conventional radially anisotropic ring magnets.

EXAMPLE 12

Coarse powder (under 320 mesh) of an R-T-B-based alloy having a main component composition comprising 30.2 weight % of Pr, 0.3 weight % of Dy, 1.6 weight % of Co, 0.1 weight % of Cu, 0.12 weight % of Al, 0.08 weight % of Ga, 0.18 weight % of Nb, and 1.0 weight % of B, the balance being Fe, was pulverized by a jet mill in an Ar atmosphere having an oxygen concentration of 1 ppm or less by volume. A slurry was formed in the same manner as in EXAMPLE 1 except for using the resultant fine powder having an average particle size of 3.5 $\mu$m. A radially anisotropic, sintered ring magnet was produced from the resultant slurry in the same manner as in EXAMPLE 10.

COMPARATIVE EXAMPLE 12

A slurry was prepared in the same manner as in COMPARATIVE EXAMPLE 1 except for using the fine powder of EXAMPLE 12 instead of the fine powder of COMPARATIVE EXAMPLE 1. Radially anisotropic, sintered ring magnet was produced in the same manner as in EXAMPLE 12 except for using this slurry.

Each of the radially anisotropic ring magnets produced in EXAMPLE 12 and COMPARATIVE EXAMPLE 12 was magnetized under the conditions of saturating the total magnetic flux to have symmetric 8 magnetic poles, and measured with respect to the total magnetic flux. As a result, the total magnetic flux of the radially anisotropic ring magnet of EXAMPLE 12 was higher than that of the radially anisotropic ring magnet of COMPARATIVE EXAMPLE 12. It was verified that the difference in the total magnetic flux between them were due to their difference in the degree of orientation in a radial anisotropy direction. Even when the radially anisotropic ring magnet of EXAMPLE 12 was kept at a liquid nitrogen temperature, the rearrangement of spins did not occur, keeping good low-temperature magnetic properties.

As described above in detail, the present invention provides a method for producing a high-performance, sintered rare earth magnet having a lower oxygen content, a higher sintering density, and a higher degree of orientation than those of the conventional sintered rare earth magnets. The present invention also provides a high-performance, sintered rare earth magnet having polar anisotropy or radial dipolar anisotropy.

What is claimed is:

1. A method for producing a sintered rare earth magnet comprising the steps of finely pulverizing a coarse rare earth magnet alloy powder to an average particle size of 1–10 $\mu$m in a non-oxidizing atmosphere; introducing the resultant fine rare earth magnet alloy powder into a non-oxidizing liquid comprising at least one oil selected from the group consisting of mineral oils, synthetic oils and vegetable oils, and at least one lubricant selected from the group consisting of esters of aliphatic acids and monovalent alcohols, esters of polybasic acids and monovalent alcohols, esters of aliphatic acids and polyvalent alcohols and their derivatives to prepare a slurry; molding said slurry; degreasing the resultant green body, sintering the degreased green body; and then heat-treating said green body.

2. The method for producing a sintered rare earth magnet according to claim 1, wherein a weight ratio of said lubricant to said fine rare earth magnet alloy powder is 0.01/99.99 to 0.5/99.5.

3. A polar anisotropic ring magnet constituted by an R—Fe—Co—Cu—B-based, sintered magnet comprising 28–33 weight % of R, wherein R is at least one rare earth element including Y, 50 atomic % or more of R being occupied by Nd, 0.8–1.5 weight % of B, 0.5–5 weight % of Co, and 0.01–0.3 weight % of Cu, the balance being substantially Fe and inevitable impurities; the amount of oxygen inevitably contained being 0.3 weight % or less based on the total weight of said ring magnet; said ring magnet having a density of 7.56 g/cm$^3$ or more; and a ratio of I (105)/I (006) being 0.5–0.8, wherein I (105) and I (006) are X-ray diffraction peak intensity measured with respect to (105) and (006) planes, respectively, at a middle position on an outer surface between magnetic poles of said ring magnet.

4. A radially dipolar ring magnet constituted by an R—Fe—Co—Cu—B-based, sintered magnet comprising 28–33 weight % of R, wherein R is at least one rare earth element including Y, 50 atomic % or more of R being occupied by Nd, 0.8–1.5 weight % of B, 0.5–5 weight % of Co, and 0.01–0.3 weight % of Cu, the balance being substantially Fe and inevitable impurities; the amount of oxygen inevitably contained being 0.3 weight % or less based on the total weight of said ring magnet; said ring magnet having a density of 7.56 g/cm$^3$ or more; said ring magnet having intrinsic coercivity iHc of 1.1 MA/m (14 kOe) or more at room temperature; and the degree of orientation expressed by $[(Br//)/(Br//)+Br\perp)]\times100(\%)$ being 85.5% or more, wherein Br// is a residual magnetic flux density in an orientation direction at room temperature, and Br⊥ is a residual magnetic flux density in a longitudinal direction perpendicular to said orientation direction.

5. A thin, sintered arc segment magnet having a thickness of 1–4 mm constituted by an R'—Fe—B-based, sintered magnet comprising 28–33 weight % of R', wherein R' is at least one of rare earth elements including Y, 50 atomic % or more of R' being occupied by Pr, 0.8–1.5 weight % of B, 5 weight % or less of Co, and 0.3 weight % or less of Cu, the balance being substantially Fe and inevitable impurities; the amount of oxygen inevitably contained being 0.3 weight % or less based on the total weight of said arc segment magnet; said arc segment magnet having a density of 7.50 g/cm$^3$ or more, a coercivity iHc of 1.1 MA/m (14 kOe) or more at room temperature, and orientation ($Br/4\pi I$) of 96% or more in an anisotropy direction.

6. A radially anisotropic, sintered arc segment magnet having an inner diameter of 100 mm or less constituted by an R'—Fe—B-based, sintered magnet comprising 28–33 weight % of R', wherein R' is at least one of rare earth elements including Y, 50 atomic % or more of I' being occupied by Pr, 0.8–1.5 weight % of B, 5 weight % or less of Co, 0.3 weight % or less of Cu, the balance being substantially Fe and inevitable impurities; the amount of oxygen inevitably contained being 0.3 weight % or less based on the total weight of said arc segment magnet; said arc segment magnet having a density of 7.50 g/cm$^3$ or more and a coercivity iHc of 1.1 MA/m (14 kOe) or more at room temperature; and the degree of orientation expressed by $[(Br//)/(Br+Br\perp)]\times100(\%)$ being 85.5% or more, wherein Br// is a residual magnetic flux density in a radial direction at room temperature, and Br⊥ is a residual magnetic flux density in a longitudinal direction perpendicular to said radial direction.

7. A radially anisotropic, sintered ring magnet having an inner diameter of 100 mm or less constituted by an R'—Fe—B-based, sintered magnet comprising 28–33 weight % of R', wherein R' is at least one of rare earth elements including Y, 50 atomic % or more of R' being occupied by Pr, 0.8–1.5 weight % of B, 5 weight % or less Co, 0.3 weight % or less of Cu, the balance being substantially Fe and inevitable impurities; the amount of oxygen inevitably contained being 0.3 weight % or less based on the total weight of said ring magnet; said ring magnet having a density of 7.50 g/cm$^3$ or more and a coercivity iHc of 1.1 MA/m (14 kOe) or more at room temperature; and the degree of orientation expressed by $[(Br//)/(Br//+Br\perp)]\times100(\%)$ being 85.5% or more, wherein Br// is a residual magnetic flux density in a radial direction at room temperature, and Br⊥ is a residual magnetic flux density in a longitudinal direction perpendicular to said radial direction.

* * * * *